US011141746B2

(12) United States Patent
Morizane

(10) Patent No.: US 11,141,746 B2
(45) Date of Patent: Oct. 12, 2021

(54) TWO-PHASE FLOW NOZZLE

(71) Applicant: MORIZANE TRANSPORTATION CO., LTD., Ehime (JP)

(72) Inventor: Kimihide Morizane, Ehime (JP)

(73) Assignee: Morizane Transportation CO., LTD, Ehime (JP)

( * ) Notice: Subject to any disclaimer, the term of this patent is extended or adjusted under 35 U.S.C. 154(b) by 0 days.

(21) Appl. No.: 16/921,295

(22) Filed: Jul. 6, 2020

(65) Prior Publication Data

US 2021/0046491 A1 Feb. 18, 2021

(30) Foreign Application Priority Data

Aug. 14, 2019 (JP) ..... JP2019-148704
Mar. 11, 2020 (JP) ..... JP2020-041440

(51) Int. Cl.
*B05B 7/06* (2006.01)

(52) U.S. Cl.
CPC ..... *B05B 7/066* (2013.01)

(58) Field of Classification Search
CPC ..... B02B 7/066; B02B 7/0416; B02B 7/0441; B02B 7/0458; B02B 7/0475
USPC ..... 239/423, 424, 433, 434
See application file for complete search history.

(56) References Cited

U.S. PATENT DOCUMENTS 10,335,811 B2 7/2019 Morizane

*Primary Examiner* — Christopher S Kim
(74) *Attorney, Agent, or Firm* — Renner, Kenner, Greive, Bobak, Taylor & Weber

(57) ABSTRACT

A two-phase flow nozzle, having limited dimensions of main parts relating to size of atomized particle and having correction means to assure the height of a gap of a gas exit, wherein said gap is formed between a lower surface of a gas nozzle and an upper surface of a liquid nozzle is provided. The nozzle is composed with the first liquid passage, the liquid nozzle with a liquid splaying exit, a concave located at an end of the liquid nozzle where said liquid exit is located lower than said end of liquid nozzle, a gas nozzle having a gap to supply compressed gas for atomizing from the outer periphery of said liquid nozzle to the liquid injected from said liquid exit, and having a gas exit, wherein said gap is formed by sticking the minute spherical extrusion composed integrally on said liquid nozzle with a lower surface of said gas nozzle. Further, the contact of said minute spherical extrusion with said upper surface of gas nozzle is automatically corrected by supporting a convex spherical supported surface, which is provided at an intermediate portion of said liquid nozzle, with a concave spherical supporting surface, which is provided at an upper inner peripheral edge of a liquid nozzle holder.

7 Claims, 10 Drawing Sheets

【Fig1】
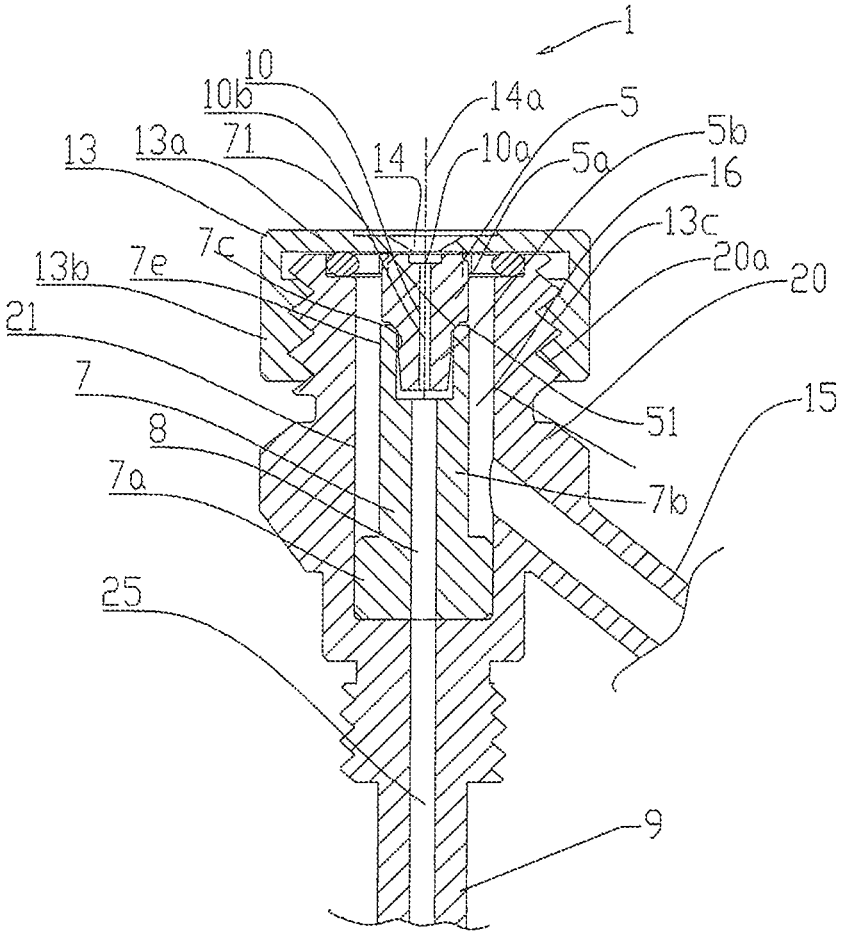

【Fig2】
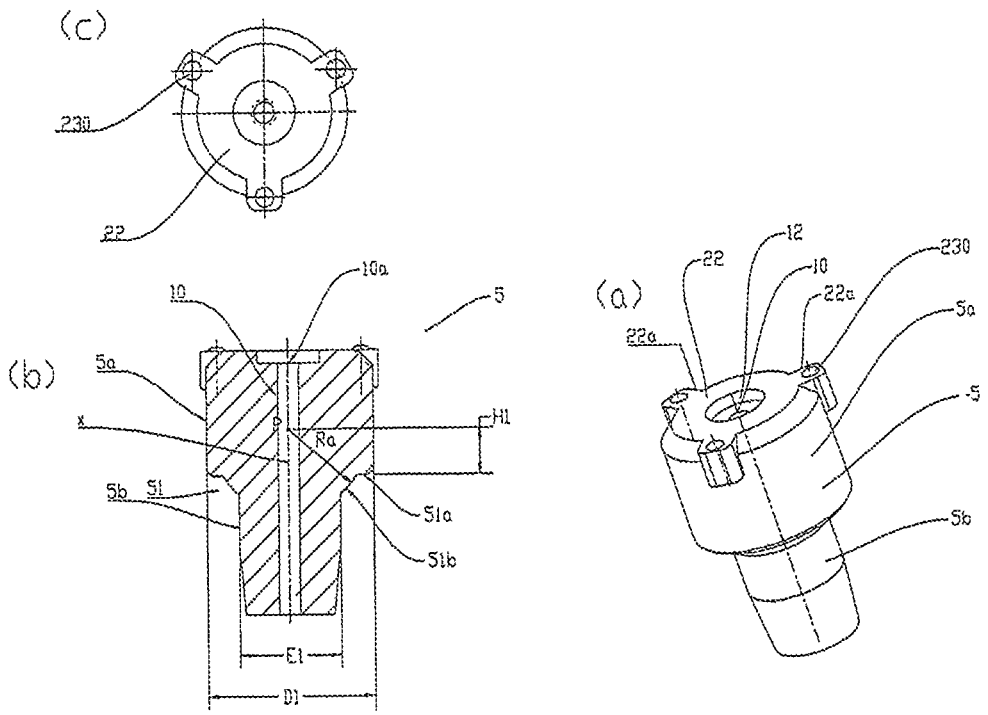

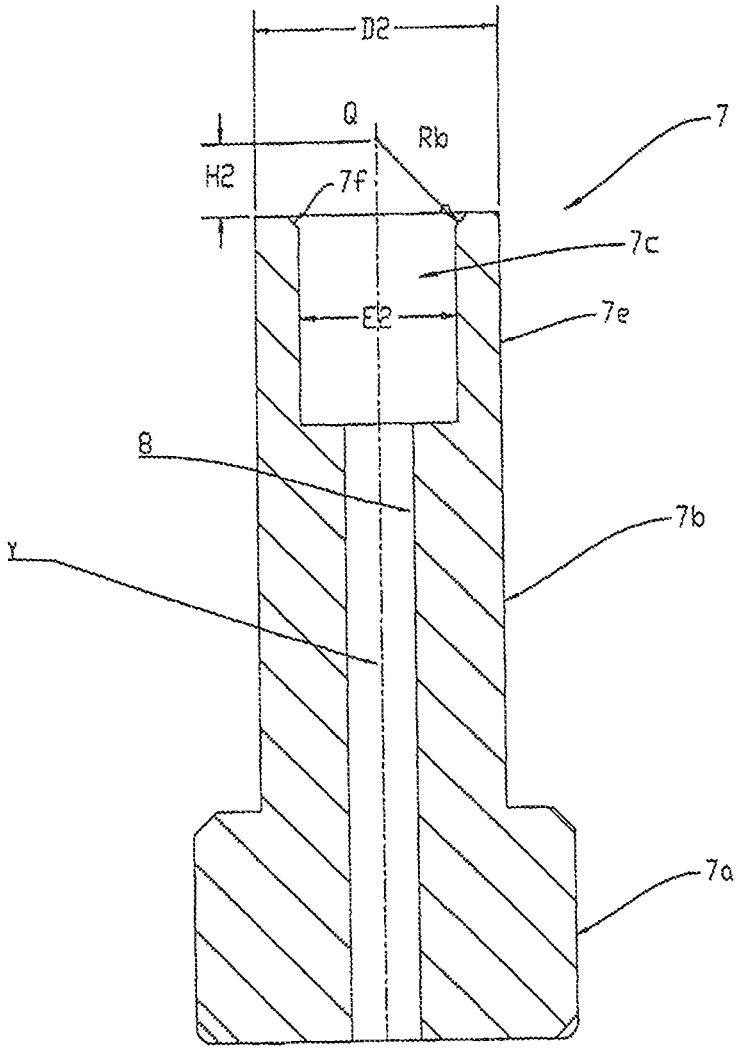
【Fig3】

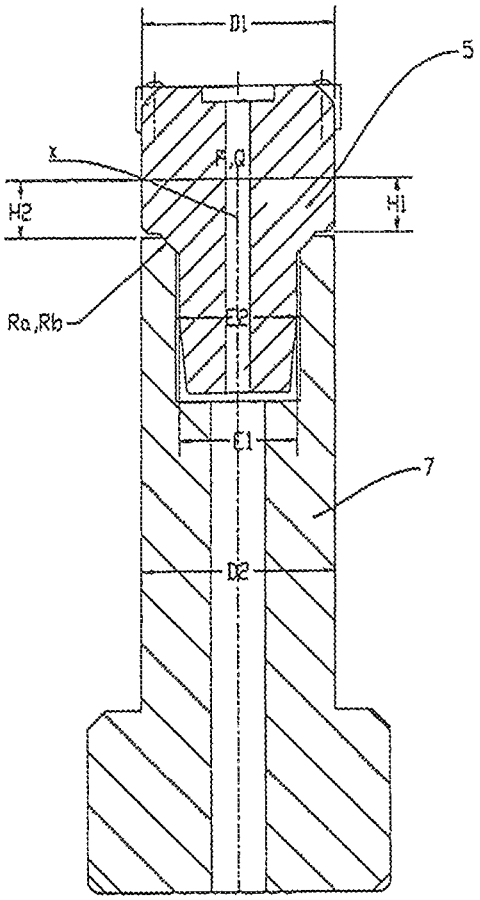
【Fig4】

【Fig5】
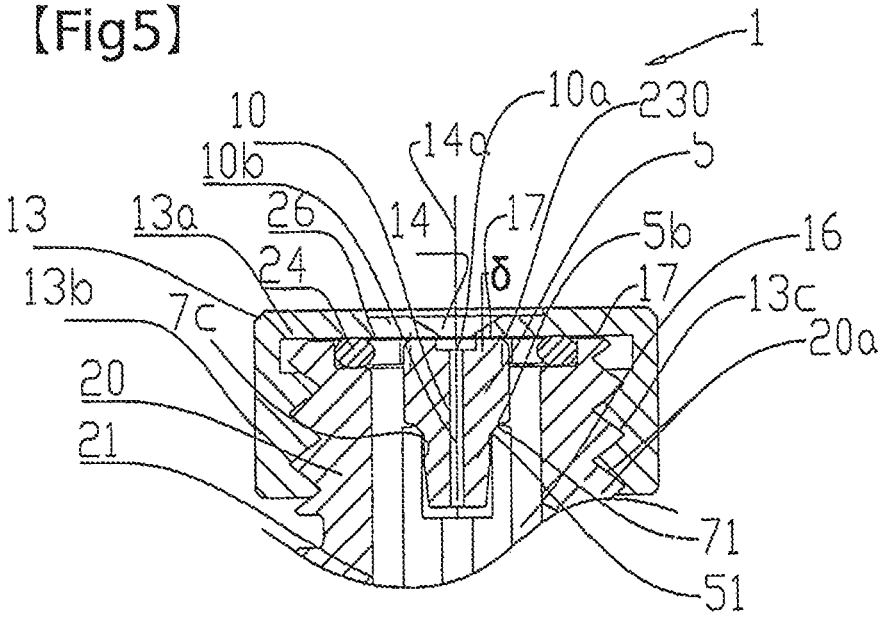

【Fig6】
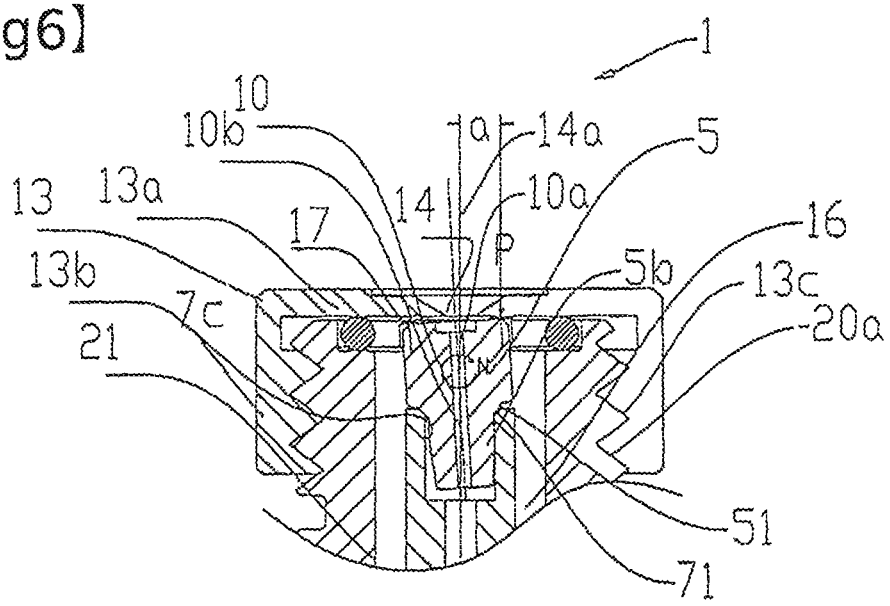

【Fig7】
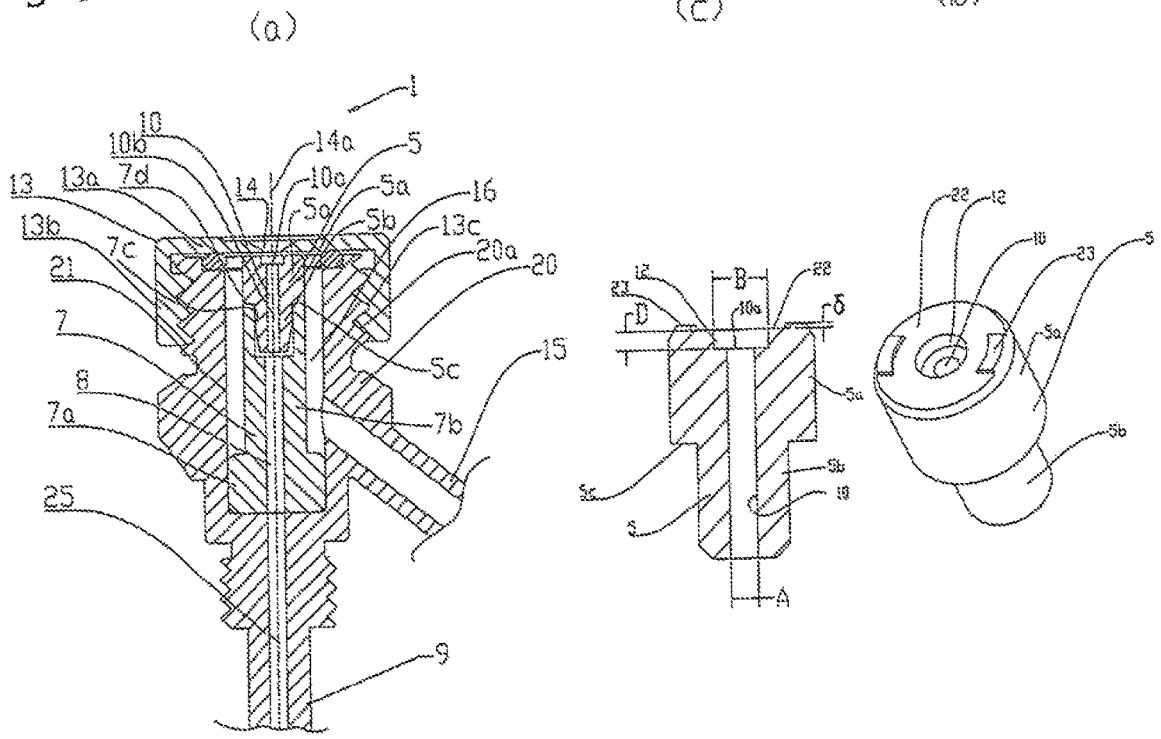
PRIOR ART

【Fig8】
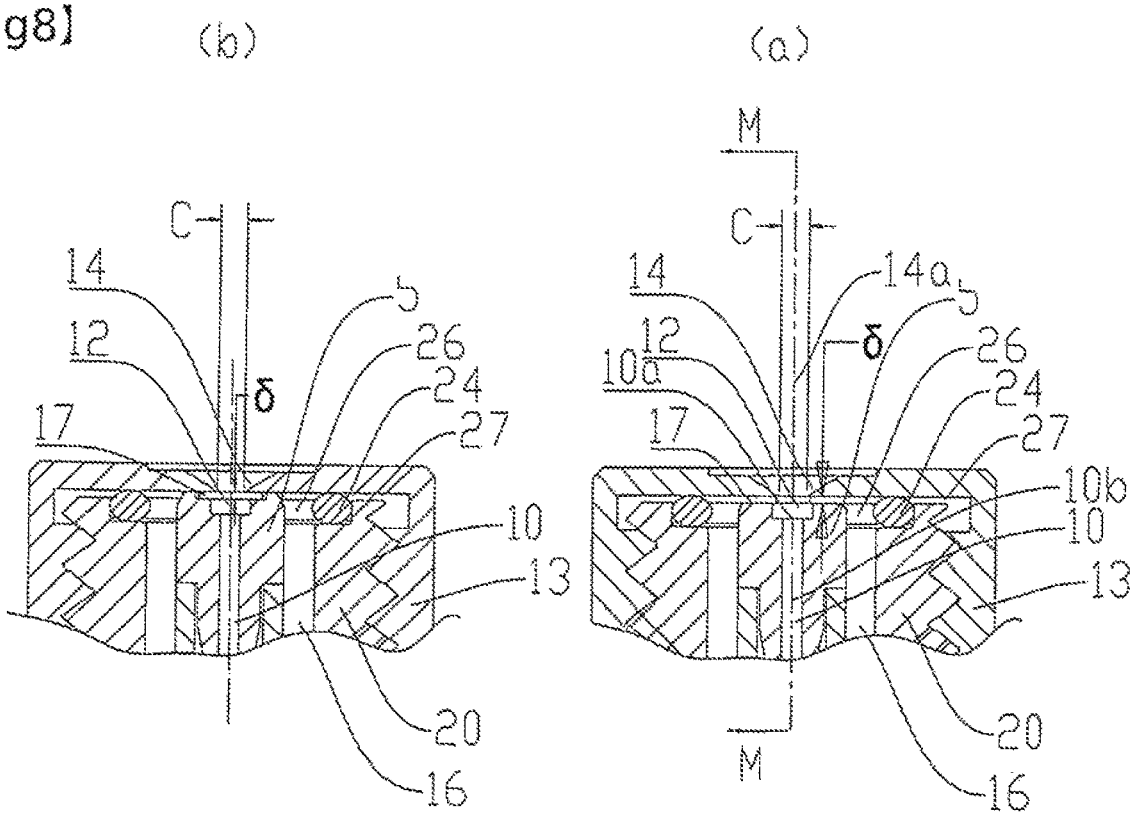
PRIOR ART

【Fig9】
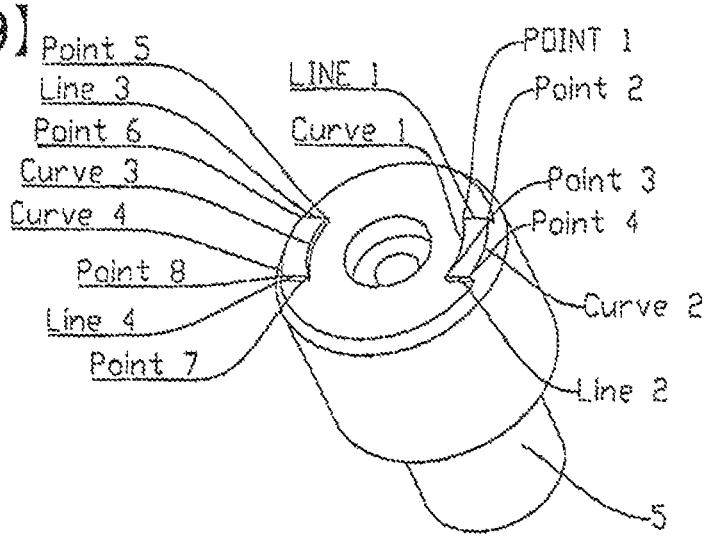
PRIOR ART

【Fig 10】
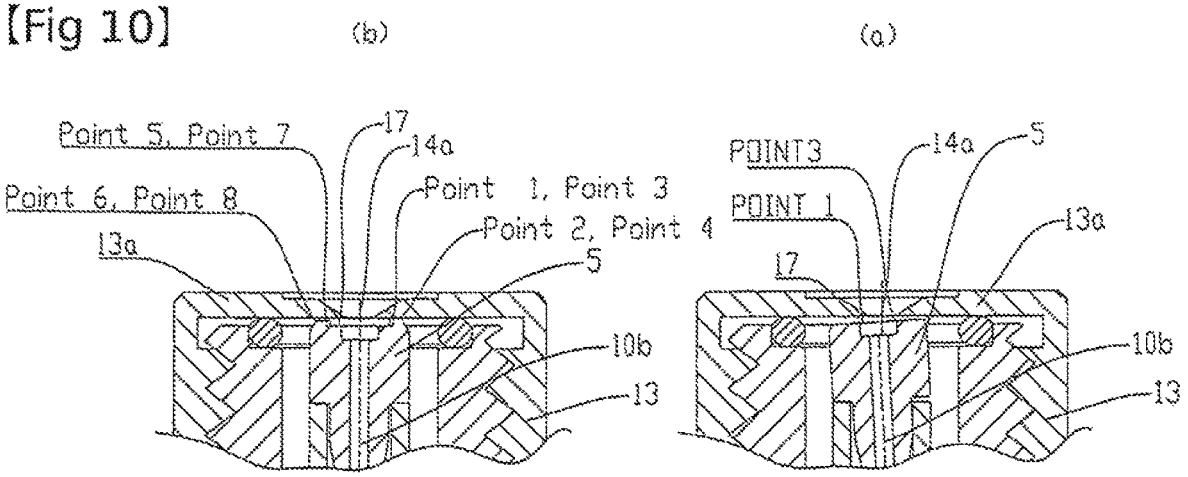
PRIOR ART

TWO-PHASE FLOW NOZZLE

FIELD OF THE INVENTION

This invention relates to a two-phase flow nozzle, more particularly, an injection nozzle to atomize mixed flow of liquid and gas. In detail, it is suitable for the use of painting equipment, fuel burning equipment, humidifier, steam iron, cooling fan using latent heat of evaporation or lubrication device for machine tools, etc.

DESCRIPTION OF THE RELATED ART

JP Utility model 3202161 and U.S. patent Ser. No. 10/335,811 disclose a related art of two-phase flow nozzle as shown on FIG. 7. As shown in FIG. 7(*a*), a two-phase nozzle 1 has a liquid nozzle 5, a gas nozzle 13 and an outer case 20. Further, as shown in FIG. 7(*a*), FIG. 7(*b*) and FIG. 7(*c*), the liquid nozzle 5 is composed with an upper portion with a larger diameter 5*a*, a lower portion with a smaller diameter 5*b* and a first liquid passage 10 which penetrates inside of it vertically. A liquid nozzle holder 7 is provided inside of the outer case 20, where said liquid nozzle holder 7 is composed of a base part 7*a* and an upper part with a smaller outer diameter 7*b* extending upwardly from said base part 7*a*, a cylindrical liquid nozzle containable space 7*c* located at the upper portion with the smaller outer diameter, a second liquid passage 8 extending from a base end of said base part 7*a* to a bottom end of said liquid nozzle containable space 7*c*, wherein the outer diameter of the upper portion with the larger diameter 5*a* of said liquid nozzle 5 and the outer diameter of the upper part with the smaller outer diameter 7*b* of said nozzle holder 7 are the same.

The lower portion with the smaller diameter 5*b* of said liquid nozzle 5 is fitted with a slight clearance (loosely fitted) to said liquid nozzle containable space 7*c* in said nozzle holder 7, where a lower surface of the upper portion with the larger diameter 5*a*, of said liquid nozzle 5 is stuck on an upper surface 7*d* of the upper part with the smaller outer diameter 7*b*, which is perpendicular to the second liquid passage 8 of the liquid nozzle holder 7.

A liquid spraying exit 10*a* is composed at a top end of said first liquid passage 10. An upper surface 22 of the liquid nozzle 5 is perpendicular to said first liquid passage 10, where a plurality of extrusions 23 having a minute height δ are provided.

Said gas nozzle 13 is composed with a circular disc portion 13*a* and a hollow circular cylindrical portion 13*b* elongated from the outer periphery of said circular disc portion 13*a* to the lower direction. At the center of said circular disc portion 13*a*, a gas exit 14 is formed, where in an inner peripheral surface of said hollow circular cylindrical portion 13*b*, a female screw 13*c* is formed. The eccentricity of a center axis 14*a* of said gas exit 14 with a center axis 14*b* of said first liquid passage 10 is desirable to be parallel and equal or less than 10% of the diameter of said first liquid passage 10. Especially, it is more preferable that both axes are coaxial.

At the outer periphery of the nozzle holder 7 in said outer case 20, a pillar like containable space 21 for containing the liquid nozzle holder 7 is provided. The base part 7*a* with a larger outer diameter of said nozzle holder 7 is installed in said liquid nozzle containable space 21 with a slight clearance. Further, on an upper periphery of said outer case 20, a male screw 20*a* to mate the female screw 13*c* on said gas nozzle 13 is formed.

As shown in FIGS. 8(*a*) and (8*b*), when said gas nozzle 13 is fastened to the upper periphery of the outer case 20 by the female screw 13*c* and the male screw 20*a*, the lower surface of the circular disc portion 13*a* is stuck on a extrusion 23 which is composed on a part of the upper surface 22 of said liquid nozzle 5 having a minute height δ, wherein a gas exiting gap 17 is formed, in a space without said extrusion 23, between the upper surface 22 of said liquid nozzle 5 and the lower surface of the circular disc portion of the gas nozzle 13.

As shown in FIG. 7, a gas passage 16 to communicate with said gas exiting gap 17 is formed between an inner wall of said containable space 21 of said outer case 20 and the upper portion with the large diameter part 5*a* and between the inner wall of said liquid nozzle containable space 21 of said outer case 20 and the outer wall of the upper part with a smaller outer diameter 7*b* of said nozzle holder 7. On the outer periphery of said outer case 20, a gas feeding tube 15 is composed to direct gas to said gas exit 14 inclining to the center axis of the gas exit 14, where said gas feeding tube 15 is communicate with said gas passage 16.

On a lower portion of said outer case 20, a liquid feeding passage 9 is composed integrally with said outer case 20. On the center of said liquid feeding passage 9, a third liquid passage 25 is formed and communicates to said second liquid passage 8.

As shown in FIG. 8, a circular liquid nozzle recess 12 is composed in the top of the liquid nozzle 5 around the center axis of the liquid spraying exit 10*a*, where the liquid spraying exit 10*a* is located slightly lower than the top end of the liquid nozzle 5. The compressed gas injected through said gas exiting gap 17 shears the compressed liquid injected from the liquid spraying exit 10*a* and atomizes the liquid, where the pressure of the gas in the liquid nozzle recess 12 becomes negative, so that a part of the gas to atomize which injects from the gas exit 14 of the gas nozzle 13, produces a turbulent flow around the liquid spraying exit 10*a*. As this turbulent flow crosses the main liquid flow injected from the liquid spraying exit 10*a* and produces turbulent in the liquid, a mist of fine particles can be obtained by using gas with low pressure and low rate of discharge.

For instance shown in FIG. 7, in case of that the liquid is water and the gas is air, the diameter of first liquid passage 10 (liquid spraying exit 10*a*): A=0.6 mm, the water pressure is 100 kPa, gas pressure is 90 kPa, the diameter of the liquid nozzle recess 12: .B=1.2 mm, the depth of the liquid nozzle recess 12: D=0.6 mm, the diameter of the gas nozzle 13: .C=0.9 mm, .δ.=0.06 mm, rate of discharge of air is 4.9 l/min, rate of water flow is 7.5 ml/min, fine atomized particles sized 10~30μ are obtained.

Further, it is found that by experiments, it is desirable that C/A=1.25~1.55, B/C=1.25~2, and D/A=0.2~1.0.

The most important dimension is the height .δ. of the fine extrusion 23 to form said gas exiting gap 17. It is desirable that δ/A=0.08~0.15, but it may be determined in accordance with the object of application. In the best illustrated case, δ is 0.06 mm. Further, because the gas nozzle 13 is fastened by a screw to the outer case 20 so as the lower surface of the circular disc portion 13*a* is stuck to the extrusion 23 of the liquid nozzle 5, the height δ of the gas exiting gap 17, which is the minimum clearance, depends only on accuracy of the height δ of the extrusion 23. The extrusion 23 formed on the liquid nozzle 5 is made by molding process of plastics or machinery process of metals integrated with the liquid nozzle 5, accuracy of the height δ. can be easily secured.

Further, when the gas nozzle 13 is fastened so as the inner surface of the gas nozzle is stuck to the extrusion 23, a slight clearance 27 is made between the upper surface of the outer case 20 and the lower surface of the circular disc portion 13*a* of the gas nozzle 13. Said slight clearance prevents said lower surface of the circular disc portion 13*a* from interference with the outer case 20 to keep the important minute clearance .δ.

Additionally, an annular recess 26 is composed on the upper surface of the outer case 20 around said containable space 21, wherein an annular elastic sealing member 24 such as O-ring is installed in said annular recess 26 and has contact with said lower surface of the gas nozzle 13 so that compressed gas in the gas passage 16 is sealed.

LIST OF PRIOR ART DOCUMENTS

Patent Documents

Patent document 1, JP Utility model 3202161
Patent Document 2, U.S. patent Ser. No. 10/335,811

SUMMARY OF THE INVENTION

Problems to be Solved by the Invention

Although the known arts above describes that the gap between the gas nozzle and the liquid nozzle which mostly influences to the size of the injected particles is easily kept to the desired value by the way that the dimension of the gap depends only on the manufacturing tolerances of a single part 5 or 13, there are other factors to influence the value of the gap δ besides that.

As the values are shown in the practical example, the dimensions of parts to compose the nozzle and that of the gap δ are small, the contact state of the top surface of the extrusions with the lower surface of the circular disc portion is important, and it is necessary to take careful attention, in production and assembling. However, influence by manufacturing error is not avoided.

As shown in FIG. 9 in detail, geometrical elements to define a top surface of the extrusions of said liquid nozzle 5 are eight points (points 1~8) and four lines (line 1~4), so that the location of the liquid nozzle in the assembly state is defined by which of these geometrical elements contacts the lower surface of the circular disc of the gas nozzle.

As a plane is defined by a set of two parallel straight lines by a geometric law, when, in FIG. 10*a* for instance, the line 1 and the line 2 are parallel and the height of them are higher than any other geometric elements, a plane including line 1 and line 2 is definitely defined and said plane is stuck to the lower surface of the gas nozzle. However, if there is a difference of heights due to manufacturing error between the point 1 on the line 1 and the point 3 on the line 2, the liquid nozzle 5 is installed inclined and the gas exiting gap becomes asymmetric about the center axis 14*a* of said gas exit 14. As the result, a mist is sprayed eccentrically to the center axis 14*a* of said gas exit 14.

In another embodiment shown in FIG. 10*b*, when the line 1 and the line 2 are parallel and the height of them are higher than any geometrical element and the height of points 1~4 are equal, the liquid nozzle 5 is installed without inclination. However, although the extrusion formed by points 5~8 in the right hand is stuck to the circular upper disc portion 13*a* of the gas nozzle 13 closely, the extrusion in the right hand have a clearance to the upper disc portion 13*a*. As the result, inflow of the gas flow becomes asymmetrical to the center axis of the gas nozzle and the mist is sprayed eccentrically to the center axis 14*a* of said gas exit 14. As shown in FIG. 7, there are many geometrical elements to define a plane, so that the geometrical law is not limited to parallel two straight lines. Since including 3 points (for example, point 1 and point 5 and point 3) or including a line and a point (for example straight line 2 and point 6) can also define a plane, so that fluctuation in the location of the liquid nozzle by manufacturing error is various.

Accordingly, it is an object of the present invention to provide a two-phase flow nozzle with compensation of variety of location of the liquid nozzle as explained above and make sure to spray correctly.

Solution to the Problems

The above-mentioned problems solved by a two phase flow nozzle of the composition which adds improvement of the following (1)~(3) to the structure of the patent document 1.

(1) On the upper surface of said liquid nozzle, a plurality of extrusions are provided to form said gas exiting gap between the upper surface of said liquid nozzle and the circular disc portion of said gas nozzle, where said extrusions are formed as an evolution curved surface having outer diameters expanded gradually from a top portion to a bottom portion, (2) Said liquid nozzle is composed of an upper portion with a larger outer diameter and a lower portion with a smaller outer diameter and an intermediate portion having outer diameters reduced gradually from the upper portion to the lower portion, where a side wall of said lower portion is a tapered surface curved from upper to lower.

(3) An intermediate portion of said liquid nozzle is comprised of an annular offset portion extending inwardly from an outer periphery of the upper portion with a larger diameter with a predetermined length, and a supported portion with a convex spherical surface extending from an inner periphery of said annular offset portion to said lower portion, where, on the other hand, on an upper portion of the liquid nozzle holder, a cylindrical part of said liquid nozzle holder is provided, wherein an upper inner peripheral edge of said cylindrical part constitutes a supporting part of a concave spherical surface which faces and supports said supported portion with the convex spherical surface.

Advantageous Effect of the Invention

It is believed that the two-phase flow nozzle in accordance with present invention will have the advantage to completely eliminate the clearance produced between the gas nozzle and the top portion of the extrusions of the liquid nozzle by a compensation function of the liquid nozzle as described in detail later, and to maintain parallelism with the center axis of gas exit of the gas nozzle and the center axis of liquid spraying exit of the liquid nozzle, whereby the mist injected from the gas nozzle directs correctly to the center axis of the gas exit.

BRIEF DESCRIPTION OF THE DRAWINGS

FIG. 1 is a cross sectional side elevation view of the two-phase flow nozzle in this invention.

FIG. 2 is a drawing of a liquid nozzle used for the two-phase flow nozzle shown in FIG. 1, where (a) is an oblique drawing of it and (b) is a cross sectional side elevation view of it and (C) is a top view of it.

FIG. 3 is a cross sectional side elevation view of the liquid nozzle holder used for the two-phase flow nozzle shown in FIG. 1.

FIG. 4 is a cross sectional side elevation view to show the state where the liquid nozzle shown in FIG. 2 is supported by the liquid nozzle holder shown in FIG. 3.

FIG. 5 is a cross sectional side elevation view of the two-phase flow nozzle shown in FIG. 1, where the main parts are enlarged to show.

FIG. 6 is a cross sectional side elevation view to explain the function of compensation in this invention, where the main parts are enlarged to show.

FIG. 7 is a drawing to explain a structure of a prior art to form fine bubbles by two-phase flow.

FIG. 8 is a drawing to explain a structure of a prior art to form fine bubbles by two-phase flow, where (b) in FIG. 8 is a cross sectional view along with line M-M in FIG. 8 (*a*).

FIG. 9 is a drawing to explain a structure of a liquid nozzle in a prior art to form fine bubbles by two-phase flow.

FIG. 10 is a drawing to explain the problems of the structure in a prior art to form fine bubbles by two-phase flow.

DESCRIPTION OF THE EMBODIMENT

A two-phase flow nozzle of the present invention will be explained referring attached drawings as followings, where names and symbols for the parts or the materials which have same function as the prior art shown in FIG. 7~FIG. 10 are put as same as them in the prior art. 1

FIG. 1 is a cross sectional side elevation view of the two-phase flow nozzle in this invention, and FIG. 5 is an enlarged view of the main parts of it. FIG. 2 is a drawing of a liquid nozzle used for the two-phase flow nozzle shown in FIG. 1, where (a) is an oblique drawing of it and (b) is a cross sectional side elevation view of it and (C) is a top view of it.

A two-phase flow nozzle 1 shown in FIG. 1 is composed with a liquid nozzle 5 and an outer case 20. The liquid nozzle 5 is formed as an evolution curved surface, which is composed with an upper portion with the larger diameter 5*a* and a lower portion with the smaller diameter 5*b* and an intermediate portion 51 having outer diameters reduced gradually from the upper portion to the lower portion, where a side wall of said lower portion is a tapered surface curved from upper to lower. A first liquid passage 10 is formed by penetrating in the liquid nozzle vertically. In said outer case 20. a pillar like containable space 21 extending vertically from a predetermined position to a upper surface direction to contain the liquid nozzle holder is provided. In this containable space 21 for the liquid nozzle holder, a nozzle holder 7 is contained, where the liquid nozzle holder 7 is provided integrally with or independently from said outer case, and, as shown in FIG. 3, is formed with an evolution body having an evolution axis y, wherein, at the lower portion of the nozzle holder, a bottom part 7*a* having an outer diameter to be able to fit adequately to said pillar like containable space 21 is installed, where an upper portion with a smaller diameter 7*b* which is elongated from said bottom part to an intermediate portion of the containable space for the liquid nozzle holder is provided, where an upward portion of said smaller diameter is cylindrical part of said nozzle holder 7*e* with an open upward end, wherein a liquid nozzle containable space 7*c* in which said bottom part of an outer periphery with a smaller outer diameter is slidably fitted, where a second liquid passage 8 which is communicated from the bottom of said bottom part 7*a* to the bottom of said containable space 7*c* of the liquid nozzle is provided, wherein a diametrical size of said upper larger part 5*a* is the same as that of said lower small diameter part 7*b*.

Said small diameter part 5*b* of said liquid nozzle 5 is installed with a slight clearance into the containable space of the liquid nozzle 7*c*.

Said intermediate portion 51, as shown in FIG. 2(*b*) clearly, is comprised of an annular offset portion 51*a* extending inwardly from an outer periphery of the upper portion with a larger diameter with a predetermined length, and a supported portion 51*b* with a convex spherical surface extending from an inner periphery of said annular offset portion to said lower portion, where, on the other hand, an upper inner peripheral edge 7*f* of the cylindrical part 7*e* of said liquid nozzle holder, as shown in FIG. 3, constitutes a supporting part 7*f* of a concave spherical surface which faces and supports said supported portion with the convex spherical surface, whereby, when said liquid nozzle 5 is installed into the containable space of the liquid nozzle 7*c*, the convex spherical surface of the supported portion 51*b* contacts with the concave spherical surface of the supporting part 7*f* of the liquid nozzle holder 7, the liquid nozzle 5 is installed inclination-freely to the center axis of the cylindrical liquid nozzle containable space 7*c*, because both contacting surfaces are spherical.

The convex spherical surface of said supported portion 51*b* is formed as a part of a spherical surface having a central point P on the axis x of the liquid nozzle 5 located upper than said supported portion 51*b* and having a radius Ra, wherein, on the other hand, the concave spherical surface of the supporting part 7*f* is formed as a part of a spherical surface having a central point Q on the axis y of the liquid nozzle holder 7 located upper than said supporting portion 7*f* located upper than the supporting portion 7*f* and having a radius Rb, wherein it is desirable that Ra=(0.96~0.99) Rb.

The reasons why the supported surface of said supported portion 51*b* is a convex spherical surface and the supporting surface of the supporting portion 7*f* is a concave spherical surface are as the followings. The two-phase flow nozzle of the present invention is usually made by plastic molding. In plastic molding, there are problems called "sink mark" and "void". "Sink mark" is a phenomenon by which a surface of a plastic molding becomes hollow a little by a shrinkage, and on the other hand, the phenomenon an air bubble (hollow) generates inside the molding is called void. There is a case which quality of molding having outward appearance surfaces becomes defective. There is a case which a sink mark is not shown on the surface of the molding article, but an air bubble (hollow) sometimes occurs inside the mold. This is void. Both sink mark and void are a phenomenon which an abnormal shrinkage occurs in cooling and solidification of a plastic molding article. Said sink mark occurs when a thick part and a thin part connect and a difference of thickness is large so that cooling and solidification speed changes each other. When the supported portion is made a concave shape, a thickness change becomes big and it is disadvantageous by a point of a sink mark. Further, because a stress is easy to concentrate at the part where a thick part and a thin part connect, if the connected part is a concave to support a convex, it is easy to receive a pressure and cause a sink mark or breakage even though it is only a assembling state. The two-phase flow nozzle of the present invention is often made with plastics, and this tendency becomes big, particularly when a sink mark or a void is occurred in a product.

A liquid spraying exit 10*a* is composed at a top end of the first liquid passage 10 of the liquid nozzle 5, where three arms 22*a* which extends to an outside of the radius direction from the upper end part are provided with an equal interval each other in a circumferential direction, where an upper surface 22 of the upper portion with the larger outer diameter including said arms 22*a* is a plane which crosses perpendicular to said first liquid passage 10, wherein on said upper surface of three arms 22*a*, which is a part of said upper surface 22, a plurality of extrusions 230 are provided to form said gas exiting gap between the upper surface of said liquid nozzle and the circular disc portion of said gas nozzle, where said extrusions are formed as an evolution curved surface having outer diameters expanded gradually from a top portion to a bottom portion, especially a semi-spherical surface, and it is desirable that three extrusions are provided together with said arms. To make a rotating moment related to the automatic corrective action most substantial for proper location of liquid nozzle 5 mentioned later, it is desirable to separate the location of said extrusions from the center axis. To achieve this, it is a way to make the diameter of liquid nozzle 5 big, but the diameter of outside case 20 has to be big to maintain the cross-sectional area of the gas passage around the liquid nozzle 5, and then, the size of the whole nozzle becomes big. On the contrary, to maintain the location of said extrusions away from the center axis as much as possible, said arms are installed, wherein the diameter of the upper portion with the larger diameter 5*a* of the nozzle 5 is not changed or rather changed to be smaller.

At an upper portion of said outer case 20, a gas nozzle 13 is provided, where said gas nozzle is composed with a circular disc portion 13*a* and a cylindrical body 13*b* elongated from the periphery of said disc portion 13*a* to the lower direction. At the center of said circular disc portion 13*a*, a gas exit 14 is formed with a center axis which is coaxial with said center axis 14*a*. At the inner wall of said cylindrical body 13*b*, a female screw 13*c* is formed. Further, on the other hand, on the upper outer periphery wall of said outer case 20, a male screw 20*a* to mate the female screw 13*c* on said gas nozzle 13 is formed. The center axis 14*a* of said gas exit 14 is parallel to a center axis 10*b* of said first liquid passage 10 and the eccentricity of the center axis of said gas exit 14 with the center axis of said first liquid passage 10 is desirable to be equal or less than 10% of the diameter of said first liquid passage 10. Especially, it is more preferable that both axes are coaxial.

As shown in FIGS. 1, 2 and 5, when said gas nozzle 13 is fastened to the upper portion of the outer case 20 by the female screw 13*c* and the male screw 20*a*, the lower surface of the circular disc portion 13*a* of the gas nozzle 13 is stuck on a extrusion 230 which is composed on a part of the upper surface 22 of said liquid nozzle 5 having a minute height δ, wherein a gas exiting gap 17 is formed, in a space without said extrusion 230, between the upper surface 22 of said liquid nozzle 5 and the lower surface of gas nozzle 13.

As shown in FIG. 1, a gas passage 16 to communicate with said gas exiting gap 17 is formed between the inner wall of said containable space 21 of said outer case 20 and the outer wall of upper portion with the larger diameter 5*a* of said liquid nozzle 5 and between the inner wall of said containable space 21 of said outer case 20 and the outer wall of the upper portion with a smaller diameter 7*b* of said nozzle holder 7. On the outer periphery of said outer case 20, a gas feeding tube 15 is composed to direct gas to said liquid spraying exit 10*a* with inclination to the center axis of said liquid spraying exit 10*a* and communicates to said gas passage 16.

On a lower portion of said outer case 20, a liquid feeding passage 9 is composed integrally with said outer case 20. On the center of said liquid feeding passage 9, a third liquid passage 25 is formed and As shown in FIG. 2, a circular liquid nozzle recess 12 is composed in the top of the liquid nozzle 5 around the center axis of the liquid spraying exit 10*a*, where the liquid spraying exit 10*a* is located slightly lower than the top end of the liquid nozzle 5. The compressed gas injected through said gas exiting gap 17 shears the compressed liquid injected from the liquid spraying exit 10*a* and atomizes the liquid, wherein the pressure of the gas in the liquid nozzle recess 12 becomes negative, so that a part of the gas to atomize, which injects from the gas exit 14 of the gas nozzle 13, produces a turbulent flow around the liquid spraying exit 10*a*. As this turbulent flow crosses the main liquid flow injected from the liquid spraying exit 10*a* and produces turbulent in the liquid, a mist of fine particles can be obtained using gas with low pressure and low rate of discharge.

As shown in FIG. 4, at the beginning of fastening of gas nozzle 13, a part or all of three extrusions 230 with spherical surface is stuck on the lower surface of the circular disc portion 13*a*. As the gas nozzle 13 is tightened up, a fastening force P is caused at a contact point of the lower surface of the circular disc portion 13*a* and the extrusions. Assuming the distance between the contact point and the center axis of the liquid nozzle containable space 7*c* to be a, a rotating moment Pxa is added to the liquid nozzle 5 and the nozzle rotates to the direction N. Because the extrusions have three spherical surfaces, the three spherical surfaces contact with the lower surface of the circular disc portion 13*a* and rotation of the liquid nozzle stops due to a geometrical law that three points define a plane. Thus, when the liquid nozzle 5 is installed, it is fixed at a right position due to the corrective action as previously described and the minute gap δ is assured.

Further, as shown in FIG. 5, when the gas nozzle 13 is fastened so as the lower surface of the gas nozzle is stuck to the extrusion 230, a slight clearance 27 is made between the upper surface of the outer case 20 and the lower surface of the circular disc portion 13*a* of the gas nozzle 13. Said slight clearance prevents said lower surface of the circular disc portion 13*a* from interference with the outer case 20 to keep the important minute clearance δ.

Additionally, an annular recess 26 is composed on the upper surface of the outer case 20 around said containable space 21, wherein an annular elastic sealing member 24 such as O-ring is installed in said annular recess 26 and has contact with said lower surface of the gas nozzle 13 so that compressed gas in the gas passage 16 is sealed with elasticity restoring force of the O-ring. It's desirable that this O-ring 24 is formed out of a rubber resilient material or a resin type resilient material or those compound materials. For example, nitrile rubber, silicone rubber, fluoric rubber, polyurethane rubber and BUCHIRUGOMU, etc. are used as rubber resilient materials.

EXPLANATION OF SYMBOLS

5; Liquid nozzle
7; Liquid nozzle holder
8; The second liquid passage
9; Liquid feeding passage
10; The first liquid passage
10*a*; Liquid spraying exit
12: Liquid nozzle recess
13: Gas nozzle

14; Gas exit
15; Gas feeding tube
16; Gas passage
17; Gas exiting gap
20; Outer case
22; Upper surface of liquid nozzle
230; Extrusions with semi-spherical surface
24; O-Ring
25; The third liquid passage
26; ANNULAR recess
27; Slight clearance.
51: Intermediate portion
71: Upper inner peripheral edge

What is claimed is:

1. A two-phase fluid spraying nozzle comprising:

an outer case;

a liquid nozzle holder which is accommodated inside said outer case;

a liquid nozzle supported on said liquid nozzle holder;

a gas nozzle having a circular disc that is spaced apart from an upper surface of said liquid nozzle so as to form gas exiting gaps therebetween;

wherein said liquid nozzle includes an upper portion with a larger outer diameter, a lower portion with a smaller outer diameter, and an intermediate portion that extends from the upper portion to the lower portion and is gradually reduced in diameter, and where a side wall of said lower portion includes a tapered surface curved vertically, wherein said outer case is provided with a cylindrical containable space for containing the liquid nozzle holder extending from a pre-determined position thereof in a vertical direction, and wherein said liquid nozzle holder is installed independent from or integrated with said outer case, said liquid nozzle holder having a base part installed in the containable space of the outer case, and a reduced diameter upper part extending vertically from the base part to a middle portion of said containable space of the outer case, and the base part having an outer diameter that has sufficient clearance for installation within the containable space, and the upper part of the reduced diameter upper part being a liquid holder part with an open upper part, and the inside thereof being the containable space for containing the lower diameter reducing part of the liquid nozzle in a loosely fitted state, wherein the intermediate portion of said liquid nozzle includes an annular offset portion that extends inwardly from an outer periphery of the larger outer diameter of the upper portion, and a supported portion with a convex spherical surface, where said supported portion extends from an inner periphery of the annular offset portion to an outer periphery of the smaller outer diameter of the lower portion, and where a concave spherical surface of the nozzle holder faces and supports said convex supported spherical surface of the supported portion of the intermediate portion of the liquid nozzle, wherein a liquid passage is provided in said liquid nozzle and opens to a liquid spraying exit at an upper part of said liquid nozzle, a circular recess at the upper surface of said liquid nozzle defining said liquid spraying exit, wherein a plurality of extrusions to form said gas exiting gaps between an upper surface of said liquid nozzle and the circular disc of said gas nozzle is provided on the upper surface of said liquid nozzle, where said plurality of extrusions are formed as a revolving surface having outer diameters expanded gradually from a top portion to a bottom portion, wherein a compressed gas for atomizing is fed from a gas passage to said gas exiting gaps, where said gas passage is formed between outer peripheries from upper portion of smaller outer diameter of said liquid nozzle holder to upper portion of larger outer diameter of said liquid nozzle and an inner periphery of containable space of said outer case, wherein said compressed gas for atomizing is fed from an outer periphery of said liquid nozzle to the liquid injected from said liquid exiting exit.

2. The two-phase nozzle as set forth in claim 1, where Ra is a radius of the convex spherical surface of said supported portion and Rb is a radius of the concave spherical surface of said supporting portion, wherein $$Ra=(0.96\sim0.99)Rb.$$

3. The two-phase nozzle as set forth in claim 1, further comprising:

a circular recess in an upper surface of said outer case surrounding the containable space for the liquid nozzle holder, a circular elastic sealing material in said circular recess, wherein the compressed gas is sealed to prevent leakage of compressed gas for atomizing, securing tightness between the upper surface of said liquid nozzle holder and the lower surface of the circular disc of said gas nozzle.

4. The two-phase nozzle as set forth in claim 1, where said extrusions are formed as an integral part of the upper surface of said liquid nozzle.

5. The two-phase nozzle as set forth in claim 1, where said liquid nozzle holder is integrated with said outer case.

6. The two-phase nozzle as set forth in claim 5, where said liquid nozzle holder and said outer case are integrated by molding plastics to form a molded plastic part.

7. The two-phase nozzle as set forth in claim 1, further comprising:

a male screw installed in an upper portion of said outer case, and in a hollow circular cylindrical portion extending downward around an outer periphery of the circular disc of said gas nozzle, and a female screw to mate with said male screw on said outer case provided inside a cylindrical surface of said hollow circular cylindrical portion, wherein the lower surface of the circular disc portion of said gas nozzle sticks to the extrusions on the upper surface of said liquid nozzle by mating these screws, and where the lower surface of the circular disc portion of said gas nozzle and the upper surface of said outer case is sealed by said circular elastic sealing material.

* * * * *